US010584470B2

(12) United States Patent
Hashinokuchi

(10) Patent No.: US 10,584,470 B2
(45) Date of Patent: Mar. 10, 2020

(54) TOILET DEVICE

(71) Applicant: LIXIL Corporation, Tokyo (JP)

(72) Inventor: Koki Hashinokuchi, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 15/755,057

(22) PCT Filed: Aug. 24, 2016

(86) PCT No.: PCT/JP2016/074660
§ 371 (c)(1),
(2) Date: Feb. 23, 2018

(87) PCT Pub. No.: WO2017/033969
PCT Pub. Date: Mar. 2, 2017

(65) Prior Publication Data

US 2018/0245325 A1 Aug. 30, 2018

(30) Foreign Application Priority Data

Aug. 27, 2015 (JP) ..... 2015-168265

(51) Int. Cl.
*E03D 9/03* (2006.01)

(52) U.S. Cl.
CPC ..... *E03D 9/03* (2013.01)

(58) Field of Classification Search
CPC ..... E03D 9/03
USPC ..... 4/223
See application file for complete search history.

(56) References Cited

U.S. PATENT DOCUMENTS 3,336,603 A * 8/1967 Leland ..... E03D 9/005 4/223
2007/0136937 A1 6/2007 Sawalski et al.
2007/0240252 A1* 10/2007 Leonard ..... E03D 9/032 4/223

(Continued)

FOREIGN PATENT DOCUMENTS

EP 2696003 2/2014
GB 2259850 3/1993

(Continued)

OTHER PUBLICATIONS

International Search Report and Written Opinion dated Oct. 11, 2016, directed to International Application No. PCT/JP2016/074660; 12 pages.

(Continued)

*Primary Examiner* — Lauren A Crane
(74) *Attorney, Agent, or Firm* — Morrison & Foerster LLP

(57) ABSTRACT

A toilet device with which a detergent tank and a pipe member connection part of a pipe member supplying a detergent to a toilet can be connected to each other without a movement of the detergent tank includes a detergent tank including a detergent tank discharge opening and a pipe member connection part connecting the detergent tank and a pipe member having a detergent supply path through which a detergent is supplied to a toilet portion after the detergent is supplied from the detergent tank to each other by being connected to the detergent tank discharge opening, in which the pipe member connection part constitutes a sliding structure advancing and retreating with respect to the detergent tank.

10 Claims, 13 Drawing Sheets

(56) References Cited

U.S. PATENT DOCUMENTS

2012/0174304 A1* 7/2012 Abbondanzio ..... E03D 9/005
4/223

FOREIGN PATENT DOCUMENTS

| | | |
|---|---|---|
| JP | 63-132193 | 8/1988 |
| JP | 2-56062 | 4/1990 |
| JP | 2003-310522 | 11/2003 |
| JP | 2011-69127 | 4/2011 |
| TW | 372560 | 10/1999 |
| TW | 514085 | 12/2002 |
| TW | 574461 | 2/2004 |
| TW | M255876 | 1/2005 |

OTHER PUBLICATIONS

Examination Report dated Mar. 13, 2017, directed to TW Application No. 105127253; 14 pages.
Examination Report dated Sep. 25, 2017, directed to TW Application No. 105127253; 10 pages.

* cited by examiner

TOILET DEVICE

REFERENCE TO RELATED APPLICATIONS

This application is a national stage application under 35 USC 371 of International Application No. PCT/JP2016/074660, filed Aug. 24, 2016, which claims the priority of Japanese Application No. 2015-168265, filed Aug. 27, 2015, the entire contents of each of which are incorporated herein by reference.

FIELD OF THE INVENTION

The present invention relates to a toilet device.

BACKGROUND OF THE INVENTION

In the related art, a toilet device includes a toilet portion and a detergent tank storing a detergent for cleaning the toilet portion. In the toilet device, a detergent tank discharge opening of the detergent tank is inserted into and connected to a tank connection port by the detergent tank being pressed with respect to a tank holder (refer to, for example, Patent Document 1).

Patent Document 1: Japanese Unexamined Patent Application, Publication No. 2011-69127

SUMMARY OF THE INVENTION

In the toilet device according to the related art, however, the detergent tank should be moved to be pressed with respect to the tank holder as described above for the detergent tank discharge opening of the detergent tank to be inserted into and connected to the tank connection port. Accordingly, the detergent tank discharge opening of the detergent tank should be connected in alignment with respect to the tank connection port in a state where the detergent tank is held, and thus the detergent tank discharge opening of the detergent tank is not easily connected to the tank connection port.

The present invention has been made in view of the above, and an object thereof is to provide a toilet device with which a detergent tank and a pipe member connection part of a pipe member supplying a detergent to a toilet portion can be connected to each other without a movement of the detergent tank.

In order to achieve the above object, the present invention provides a toilet device including a detergent tank (such as a detergent tank 50 to be described later) including a detergent tank discharge opening (such as a detergent tank discharge opening 54 to be described later) and a pipe member connection part (such as a pipe member connection part 56 to be described later) connecting the detergent tank and a pipe member (such as a hose 55 to be described later) having a detergent supply path through which a detergent is supplied to a toilet portion (such as a toilet portion 10 to be described later) after the detergent is supplied from the detergent tank to each other by being connected to the detergent tank discharge opening, in which the pipe member connection part constitutes a sliding structure advancing and retreating with respect to the detergent tank.

Preferably, the sliding structure has a connection receiving portion (such as a connection receiving portion 33 to be described later) disposed in a support member (such as a base plate 31 to be described later) supporting the detergent tank, supporting the pipe member connection part, and guiding the pipe member connection part such that the pipe member connection part advances and retreats with respect to the detergent tank.

Preferably, the connection receiving portion has an outflow detergent flow path (such as an outflow detergent flow path 335 to be described later) allowing inflow of the detergent flowing out from the detergent supply path. Preferably, the outflow detergent flow path is inclined toward a detergent tank holding portion of the support member holding the detergent tank. Preferably, the detergent tank discharge opening has an inserted portion (such as a discharge tube portion 544 to be described later) into which the pipe member connection part can be inserted.

Preferably, the connection receiving portion has a first engaged portion (such as a receiving portion notch 341 to be described later) and the pipe member connection part includes a first engaging portion (such as a projection portion 562 to be described later) that can be engaged with the first engaged portion when the pipe member connection part is connected to the detergent tank discharge opening.

Preferably, the connection receiving portion has a surrounding wall portion (such as a surrounding wall portion 342 to be described later) surrounding a part of the pipe member connection part and a receiving portion notch (such as the receiving portion notch 341 to be described later) constituting the first engaged portion and extending in a circumferential direction with respect to an axial direction of the pipe member connection part corresponding to a direction in which the pipe member connection part advances and retreats and the pipe member connection part includes a shaft portion (such as a shaft portion 561 to be described later) and a projection portion (such as the projection portion 562 to be described later) constituting the first engaging portion and protruding in a direction away from the shaft portion.

Preferably, the connection receiving portion has a second engaged portion (such as an annular portion 333 to be described later) and the pipe member connection part includes a second engaging portion (such as a protruding portion 563 to be described later) that can be engaged with the second engaged portion when the pipe member connection part is removed from the detergent tank.

Preferably, a rear end portion (such as the annular portion 333 to be described later) of the connection receiving portion in the direction in which the pipe member connection part advances and retreats constitutes the second engaged portion and a pair of protruding portions (such as the protruding portion 563 to be described later) extending in a direction away from a shaft center of the pipe member connection part in a rear end portion of the pipe member connection part in the direction in which the pipe member connection part advances and retreats constitutes the second engaging portion.

With the present invention, a toilet device that can be easily operated can be provided.

DETAILED DESCRIPTION OF THE INVENTION

Figure 1:
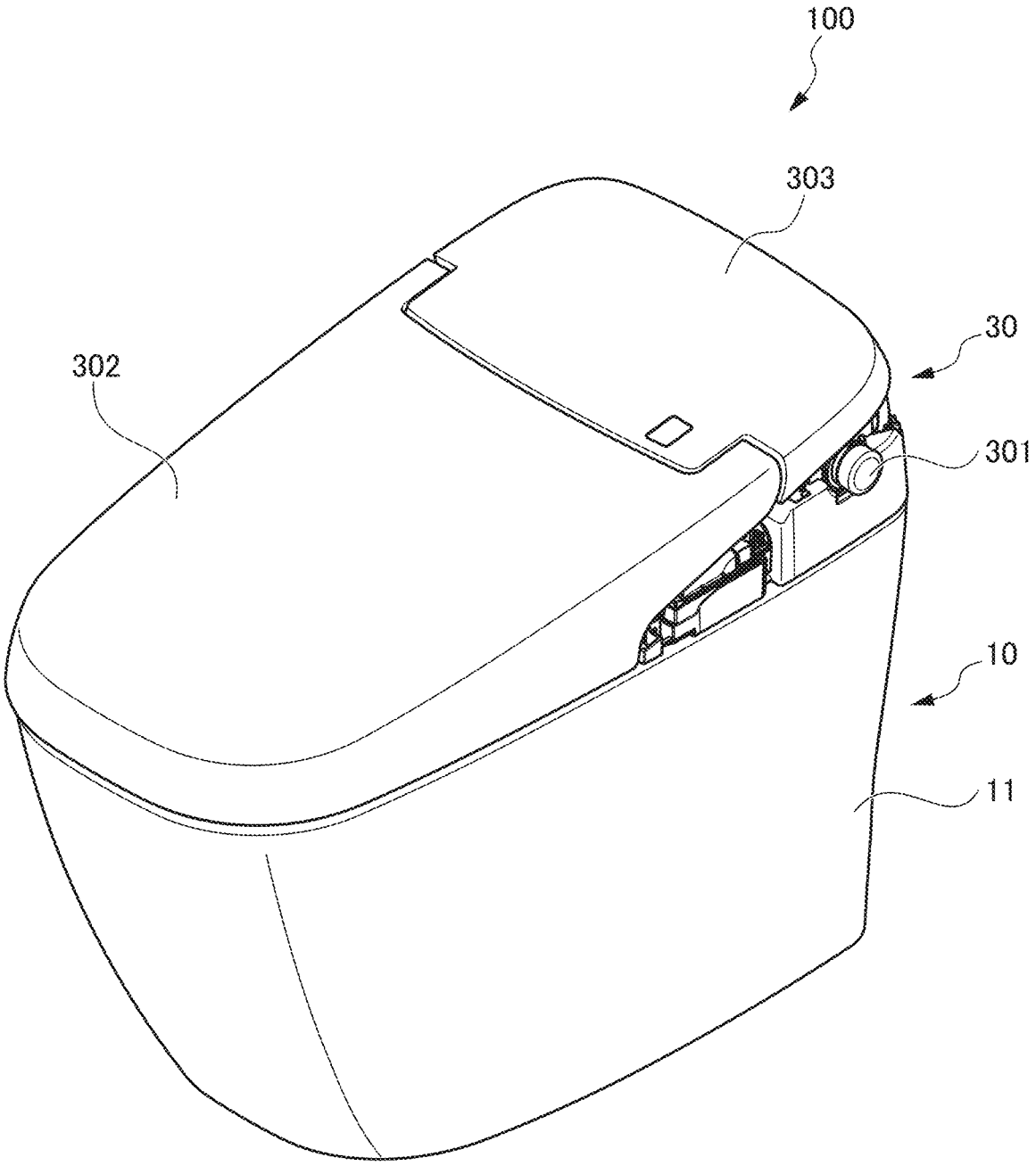
FIG. 1 is a perspective view of a toilet device 100 according to an embodiment of the present invention.
Figure 2:
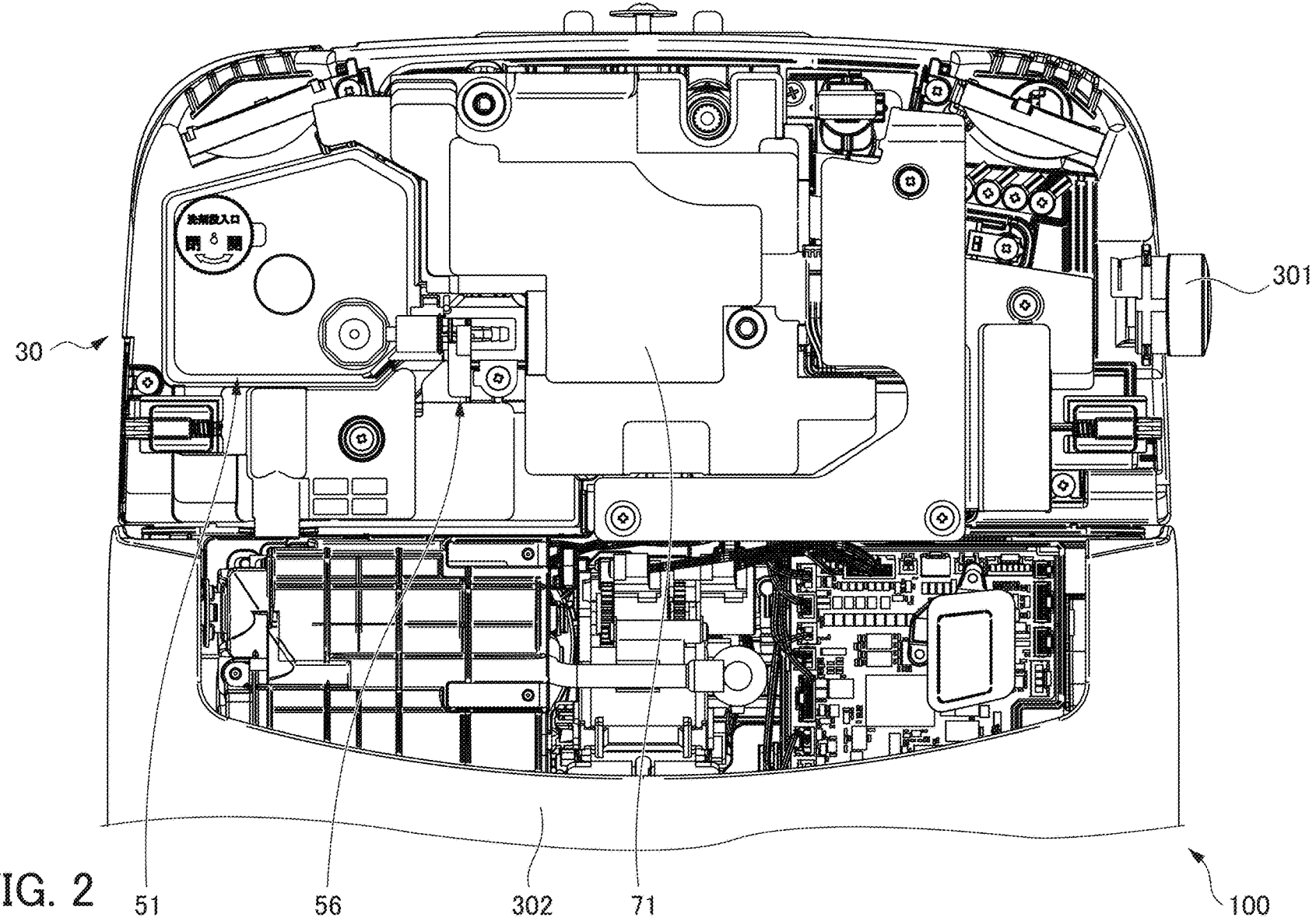
FIG. 2 is an enlarged plan view illustrating a state where a rear upper surface cover 303 is removed from the toilet device 100 according to the embodiment.

Hereinafter, a preferred embodiment of a toilet device 100 of the present invention will be described with reference to drawings. Firstly, an overall configuration of the toilet device 100 according to the embodiment of the present invention will be described with reference to FIGS. 1 and 2. FIG. 1 is a perspective view of the toilet device 100 according to the embodiment of the present invention. FIG. 2 is an enlarged plan view illustrating a state where a rear upper surface cover 303 is removed from the toilet device 100 according to the embodiment.

The toilet device 100 of the present embodiment is provided with a toilet portion 10 and a functional unit 30 as illustrated in FIG. 1, and cleaning water supplied from an external water supply source is stored in a cleaning water tank disposed in the toilet portion 10.

The toilet portion 10 has a toilet main body 11. In addition, the toilet portion 10 has a pump (not illustrated) and an ejector (not illustrated). A detergent stored in a detergent tank 50 of the functional unit 30 is supplied to the ejector through a hose 55 by driving of the pump, mixed with water and air, and supplied to a bowl portion in the toilet portion 10. The ejector allows the detergent and bowl cleaning water to contain microbubbles by generating the microbubbles by performing mixing with air and making the air fine. The water surface of the bowl cleaning water stored in the lower portion of the bowl portion in the toilet portion 10 is covered by the bowl cleaning water allowed to contain the microbubbles by the ejector. The microbubbles contained in the bowl cleaning water demonstrate noise reduction and water splash prevention effects at a time when urine drops onto the water surface.

The functional unit 30 has a base plate 31 as a support member. The base plate 31 is fixed to the upper surface of a fixing plate 111 (refer to FIG. 11). As a result, the functional unit 30 is fixed to the rear upper surface of the toilet main body 11. Each member such as the detergent tank 50 storing the detergent and the hose 55 as a pipe member for supplying the detergent from the detergent tank 50 to the ejector is accommodated in the base plate 31. In addition, a part of the hose 55 as the pipe member accommodated in the base plate 31 to supply the detergent from the detergent tank 50 to the toilet portion 10 is covered by a hose facing cover 71 from above. In addition, the entire upper portion of the base plate 31 is covered by the rear upper surface cover 303. In addition, the front portion of the functional unit 30 pivotally supports a toilet seat (not illustrated) and a toilet cover 302 in a rotatable manner.

Figure 3:
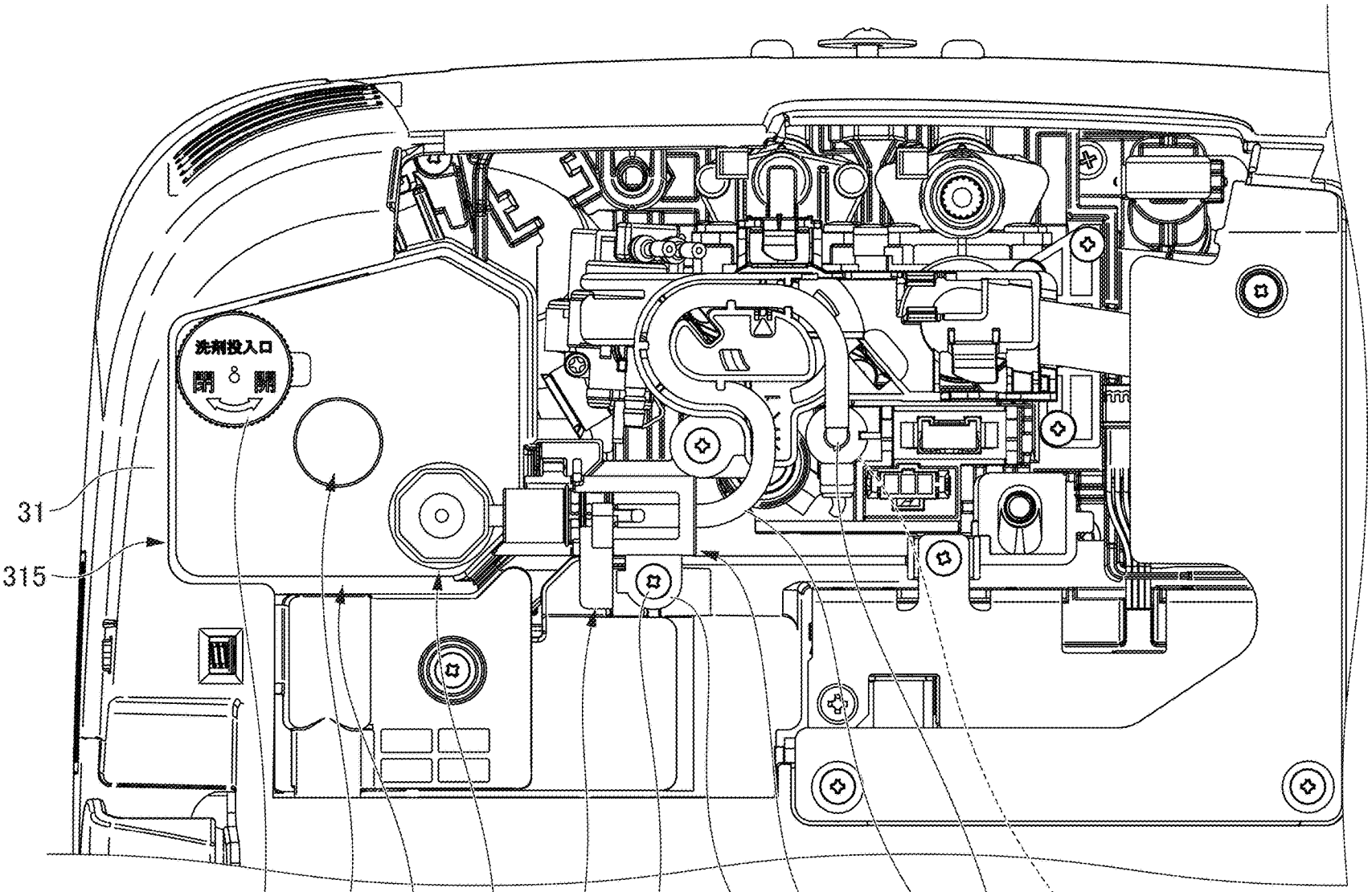
FIG. 3 is an enlarged plan view illustrating a state where the rear upper surface cover 303 and a hose facing cover 71 are removed from the toilet device 100 according to the embodiment.
Figure 4:
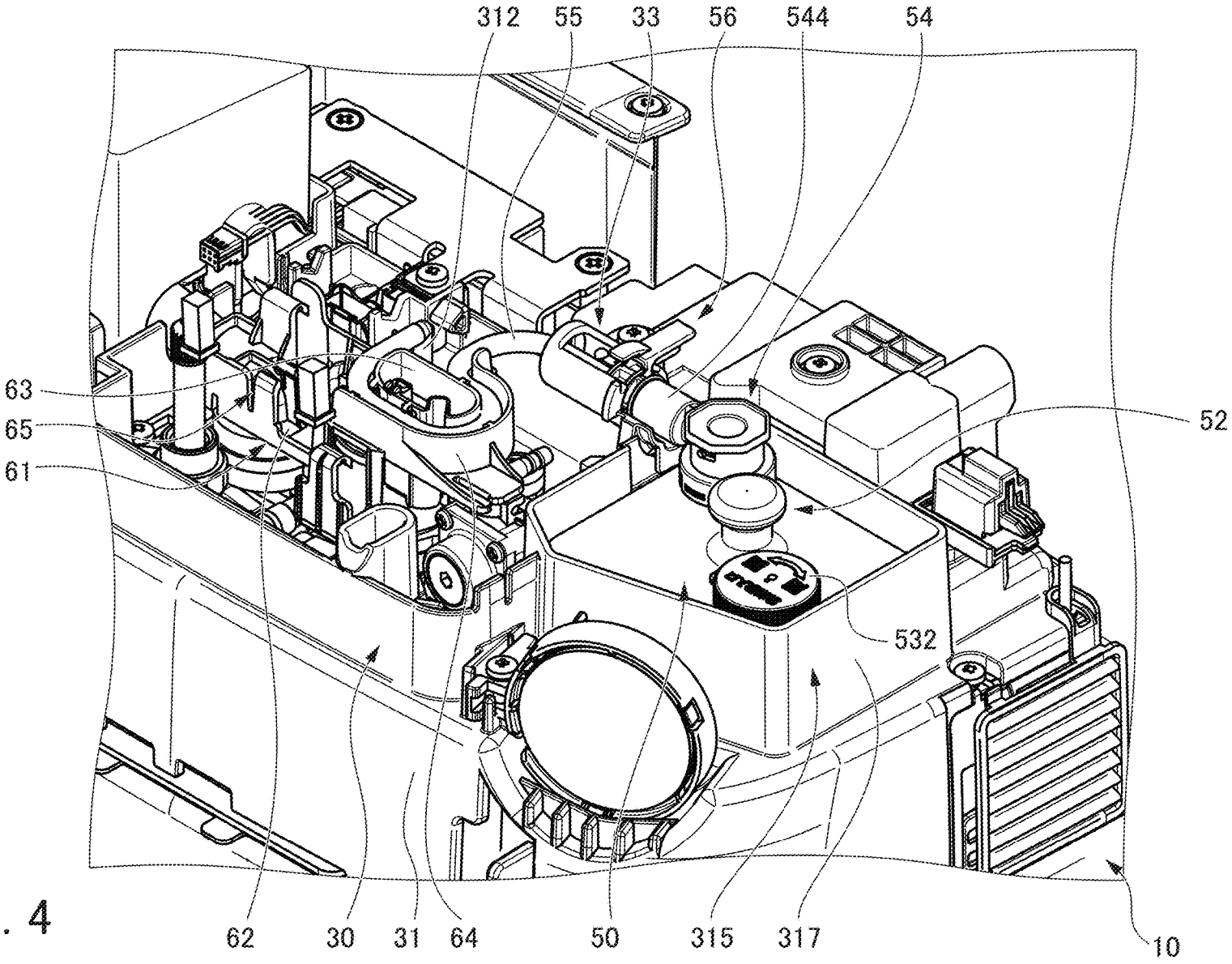
FIG. 4 is an enlarged perspective view illustrating the state where the rear upper surface cover 303 and the hose facing cover 71 are removed from the toilet device 100 according to the embodiment.
Figure 5:
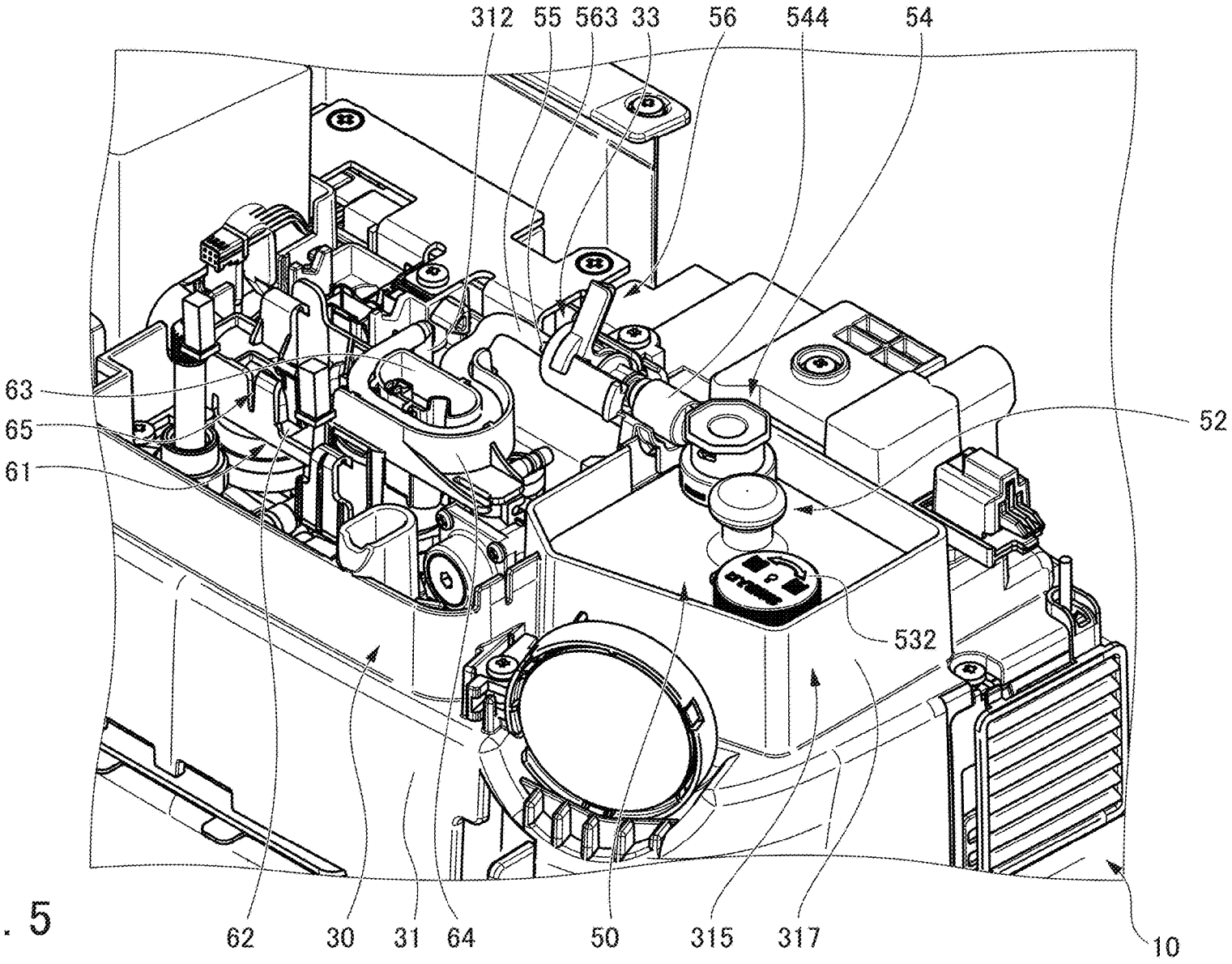
FIG. 5 is an enlarged perspective view illustrating a state where the rear upper surface cover 303 and the hose facing cover 71 are removed from the toilet device 100 according to the embodiment and a pipe member connection part 56 is removed from a discharge tube portion 544 of a detergent tank discharge opening 54.
Figure 6:
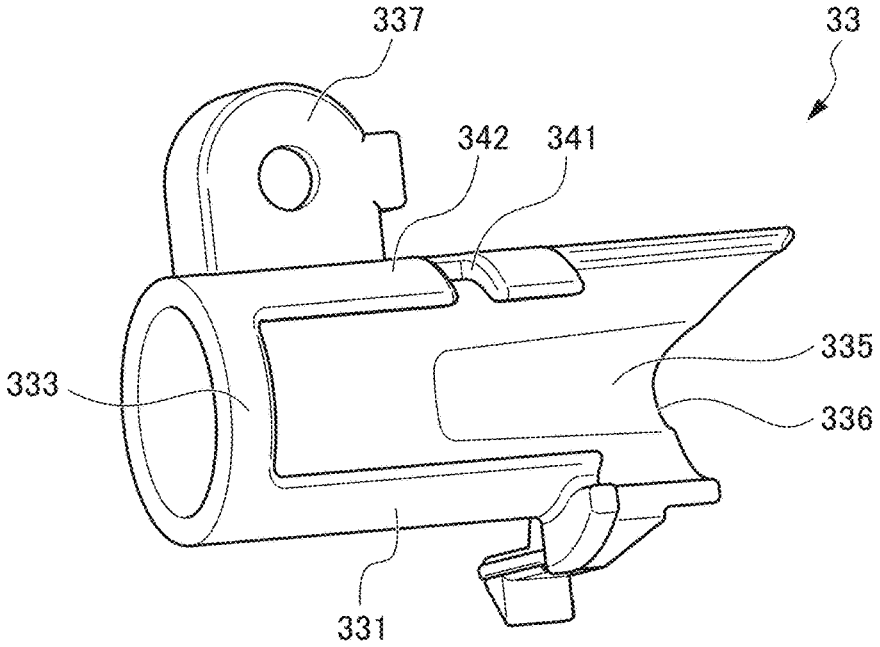
FIG. 6 is an enlarged perspective view illustrating a connection receiving portion 33 of the toilet device 100 according to the embodiment.
Figure 7:
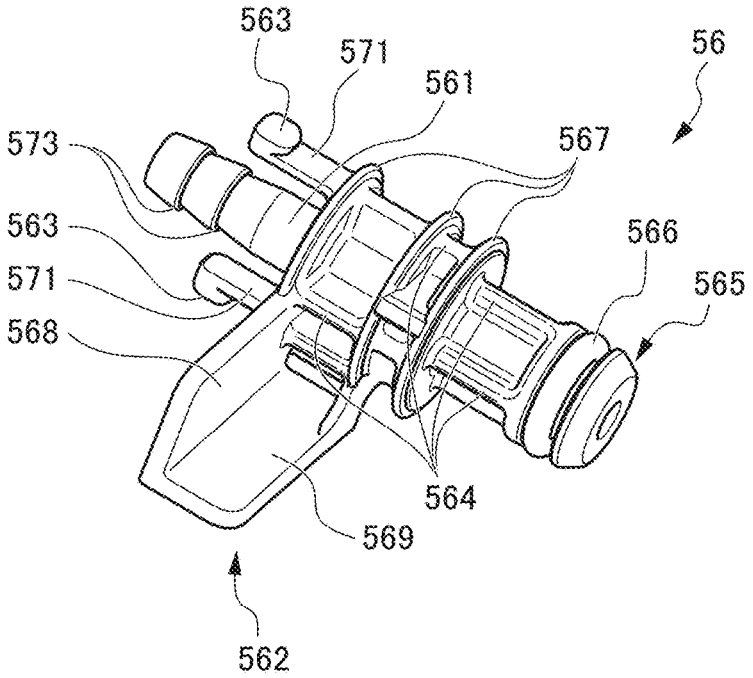
FIG. 7 is an enlarged perspective view illustrating the pipe member connection part 56 of the toilet device 100 according to the embodiment.
Figure 8:
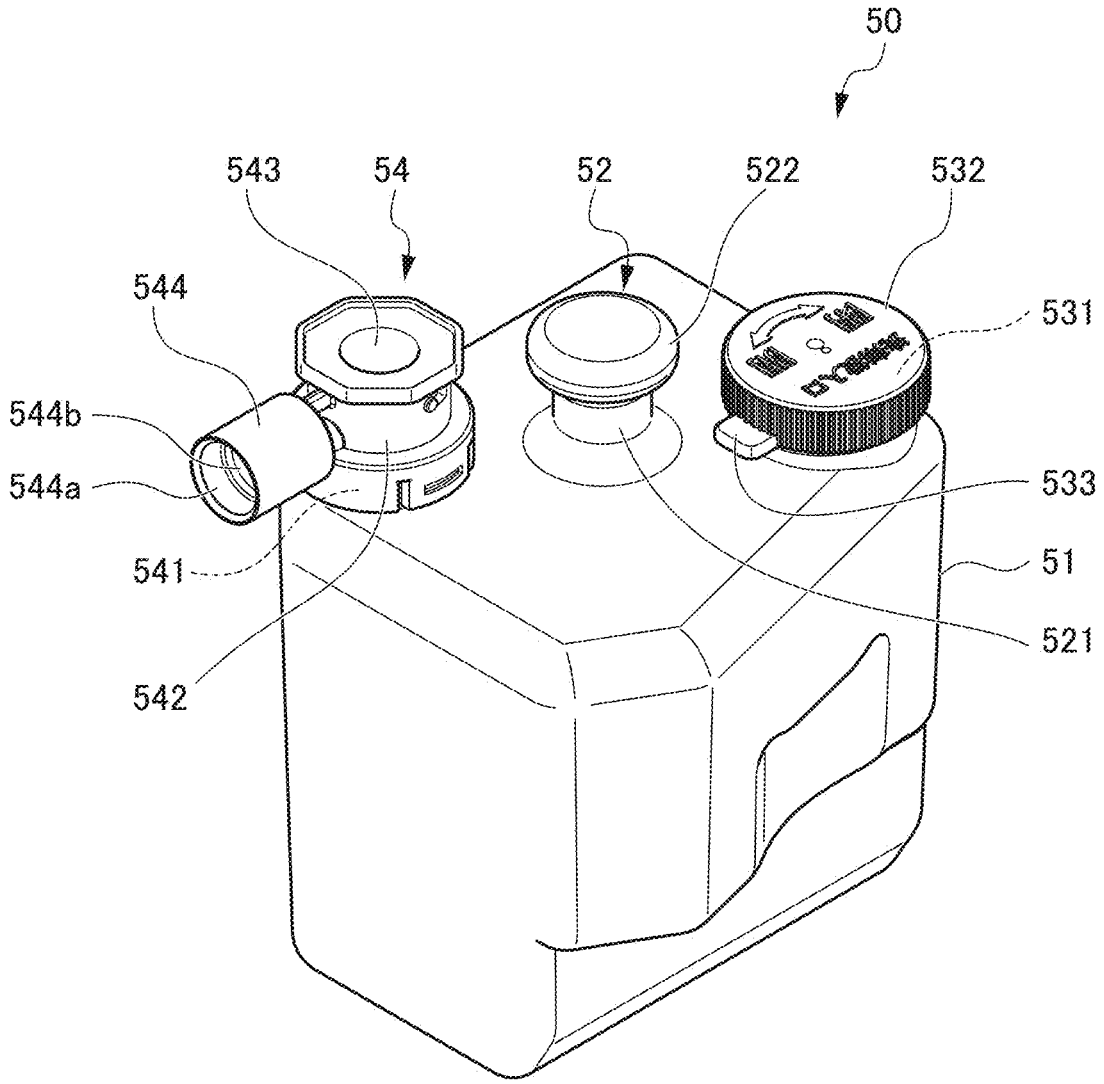
FIG. 8 is an enlarged perspective view illustrating a detergent tank 50 of the toilet device 100 according to the embodiment.
Figure 9:
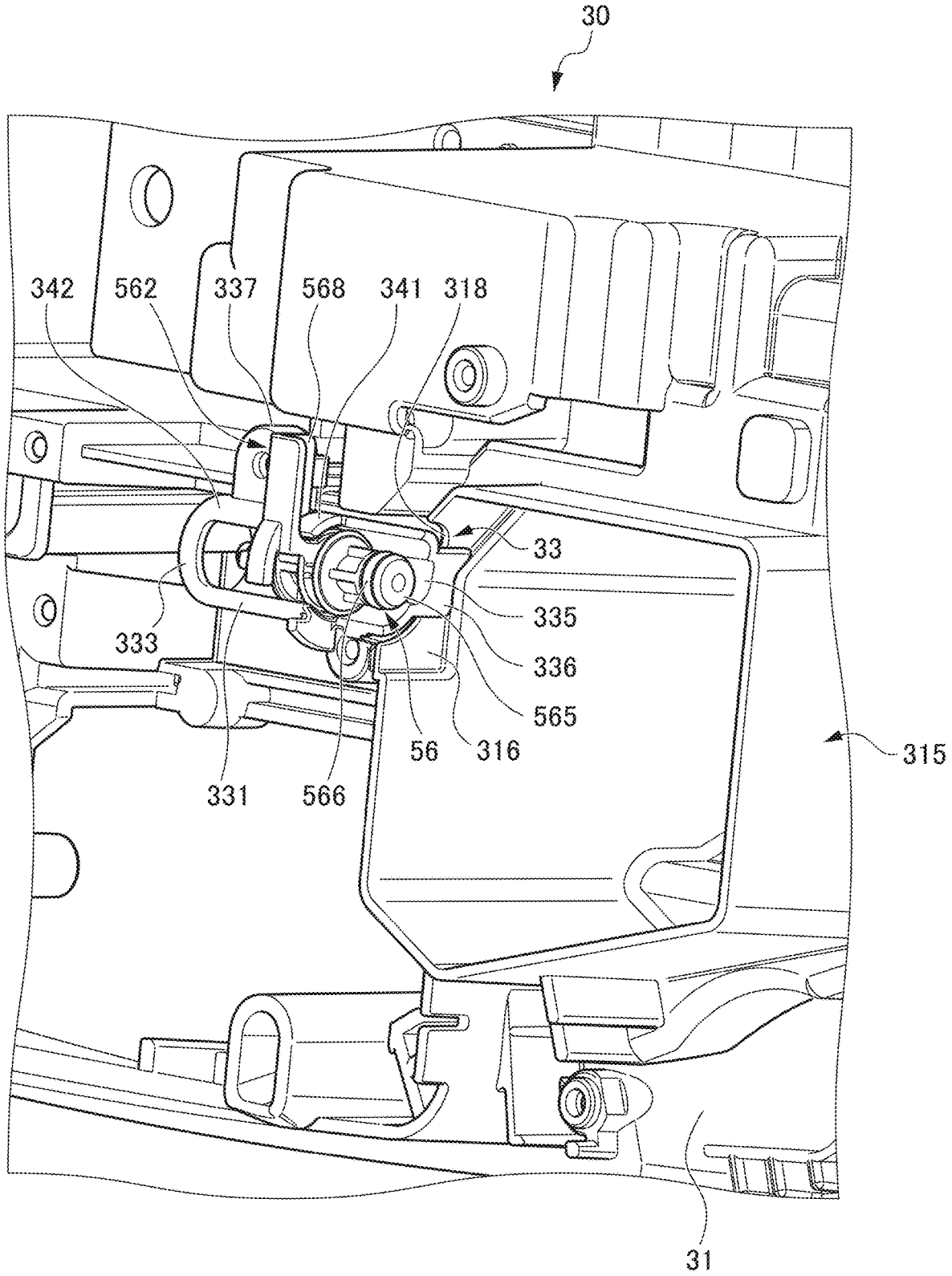
FIG. 9 is an enlarged perspective view illustrating a positional relationship between a detergent tank holding portion 315 of a base plate 31 and an outflow detergent flow path 335 of the toilet device 100 according to the embodiment.
Figure 10:
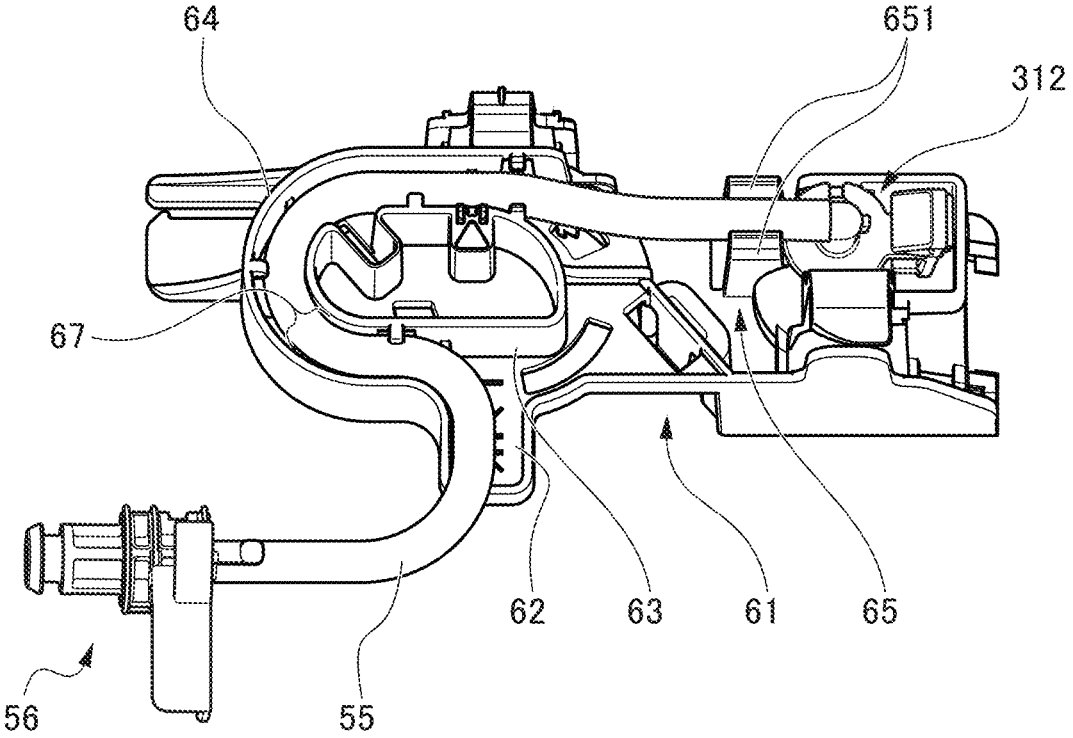
FIG. 10 is an enlarged plan view illustrating a state where the part near one end portion of a hose 55 is sandwiched and primarily fixed by a pair of hook portions 651 of a pipe member holding portion 61 of the toilet device 100 according to the embodiment.

Each portion will be described in detail below with reference to FIGS. 3 to 14. FIG. 3 is an enlarged plan view illustrating a state where the rear upper surface cover 303 and the hose facing cover 71 are removed from the toilet device 100 according to the embodiment. FIG. 4 is an enlarged perspective view illustrating the state where the rear upper surface cover 303 and the hose facing cover 71 are removed from the toilet device 100 according to the embodiment. FIG. 5 is an enlarged perspective view illustrating a state where the rear upper surface cover 303 and the hose facing cover 71 are removed from the toilet device 100 according to the embodiment and a pipe member connection part 56 is removed from a discharge tube portion 544 of a detergent tank discharge opening 54. FIG. 6 is an enlarged perspective view illustrating a connection receiving portion 33 of the toilet device 100 according to the embodiment. FIG. 7 is an enlarged perspective view illustrating the pipe member connection part 56 of the toilet device 100 according to the embodiment. FIG. 8 is an enlarged perspective view illustrating the detergent tank 50 of the toilet device 100 according to the embodiment. FIG. 9 is an enlarged perspective view illustrating a positional relationship between a detergent tank holding portion 315 of the base plate 31 and an outflow detergent flow path 335 of the toilet device 100 according to the embodiment. FIG. 10 is an enlarged plan view illustrating a state where the part near one end portion of the hose 55 is sandwiched and primarily fixed by a pair of hook portions 651 of a pipe member holding portion 61 of the toilet device 100 according to the embodiment.

Figure 11:
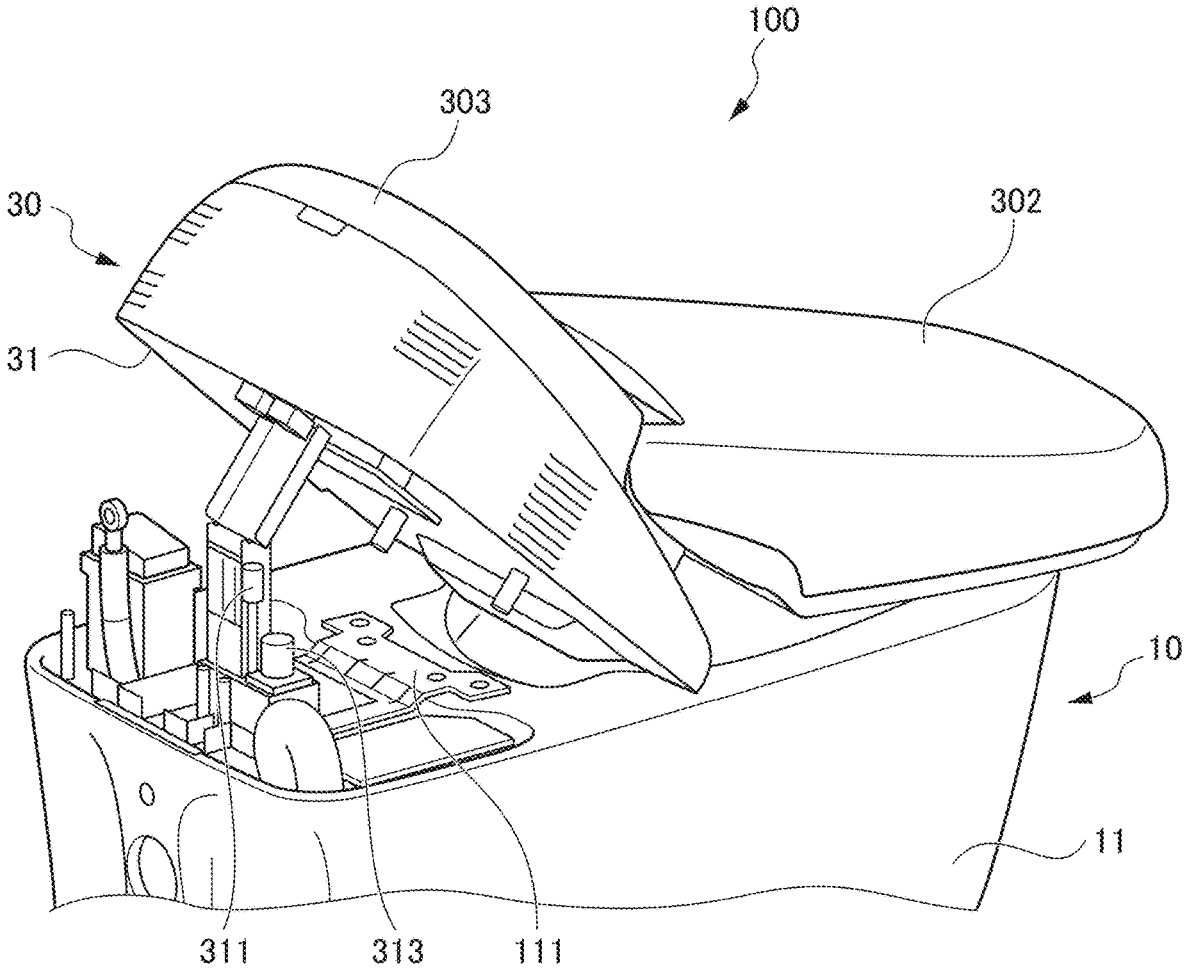
FIG. 11 is a perspective view illustrating a state where a functional unit 30 of the toilet device 100 according to the embodiment of the present invention is yet to be fixed with respect to a toilet portion 10.
Figure 12:
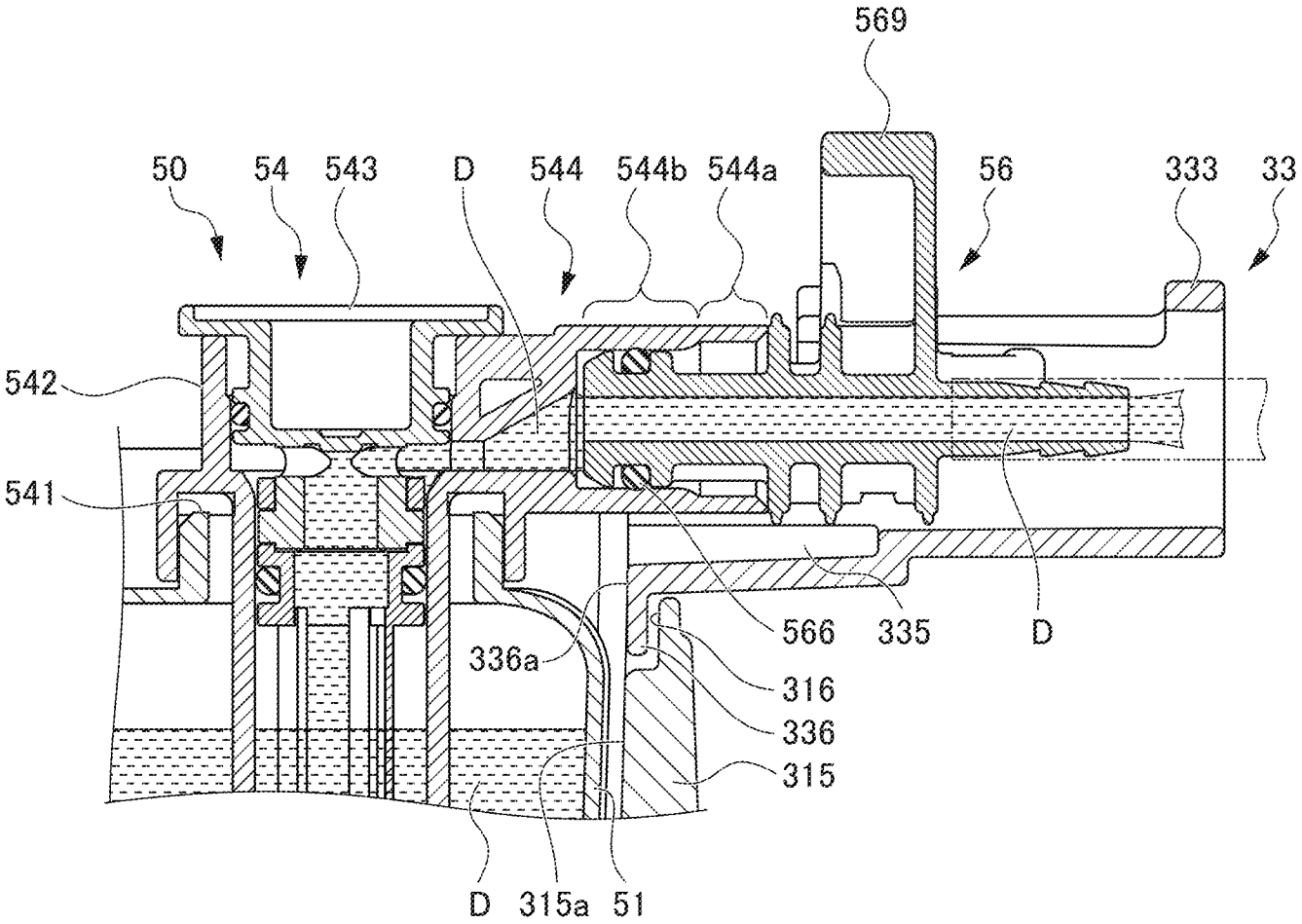
FIG. 12 is an enlarged sectional view illustrating a state where the pipe member connection part 56 is inserted into and connected to the detergent tank discharge opening 54 of the detergent tank 50 of the toilet device 100 according to the embodiment.
Figure 13:
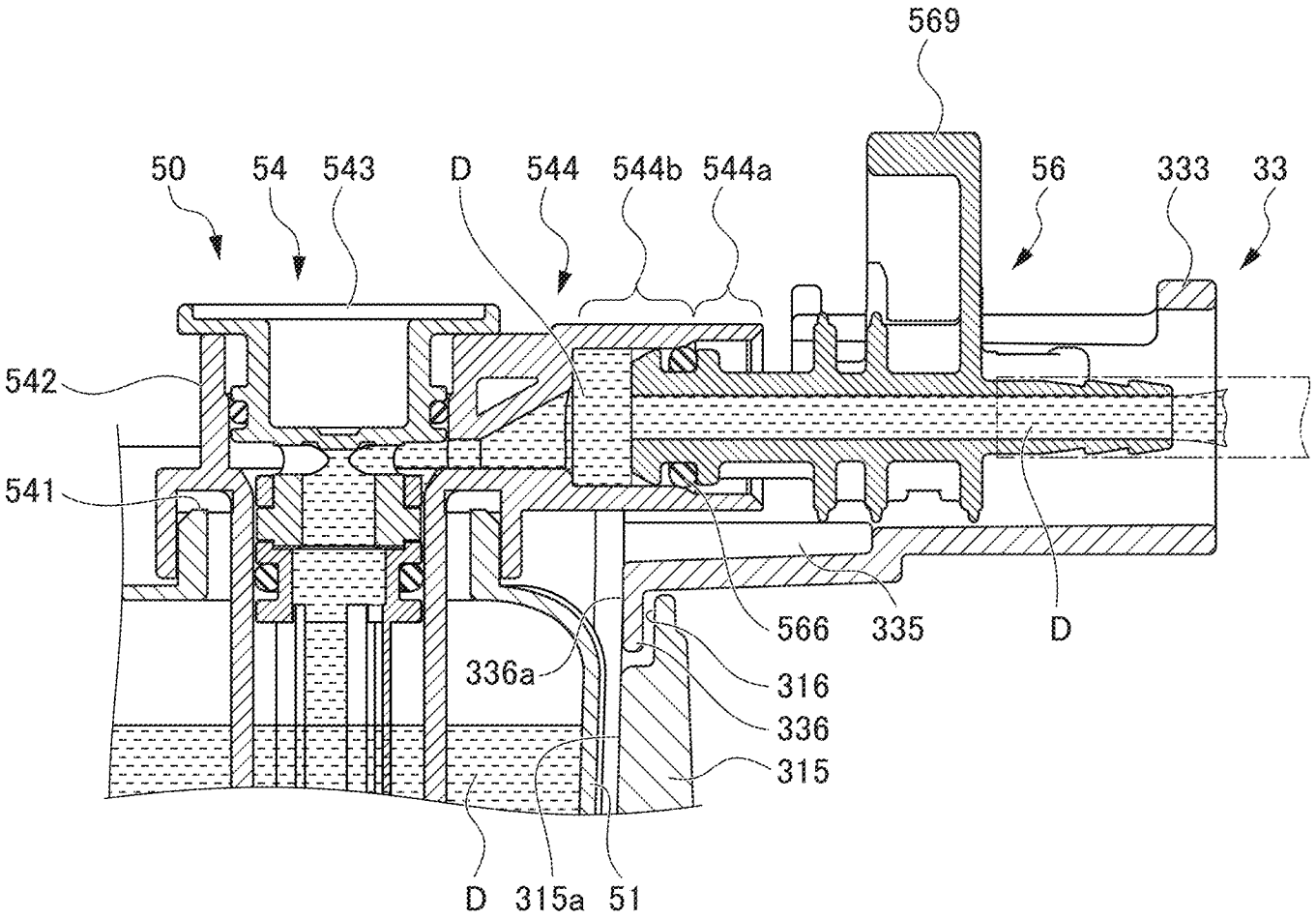
FIG. 13 is an enlarged sectional view illustrating a state where the pipe member connection part 56 begins to be pulled out from the detergent tank discharge opening 54 of the detergent tank 50 of the toilet device 100 according to the embodiment.
Figure 14:
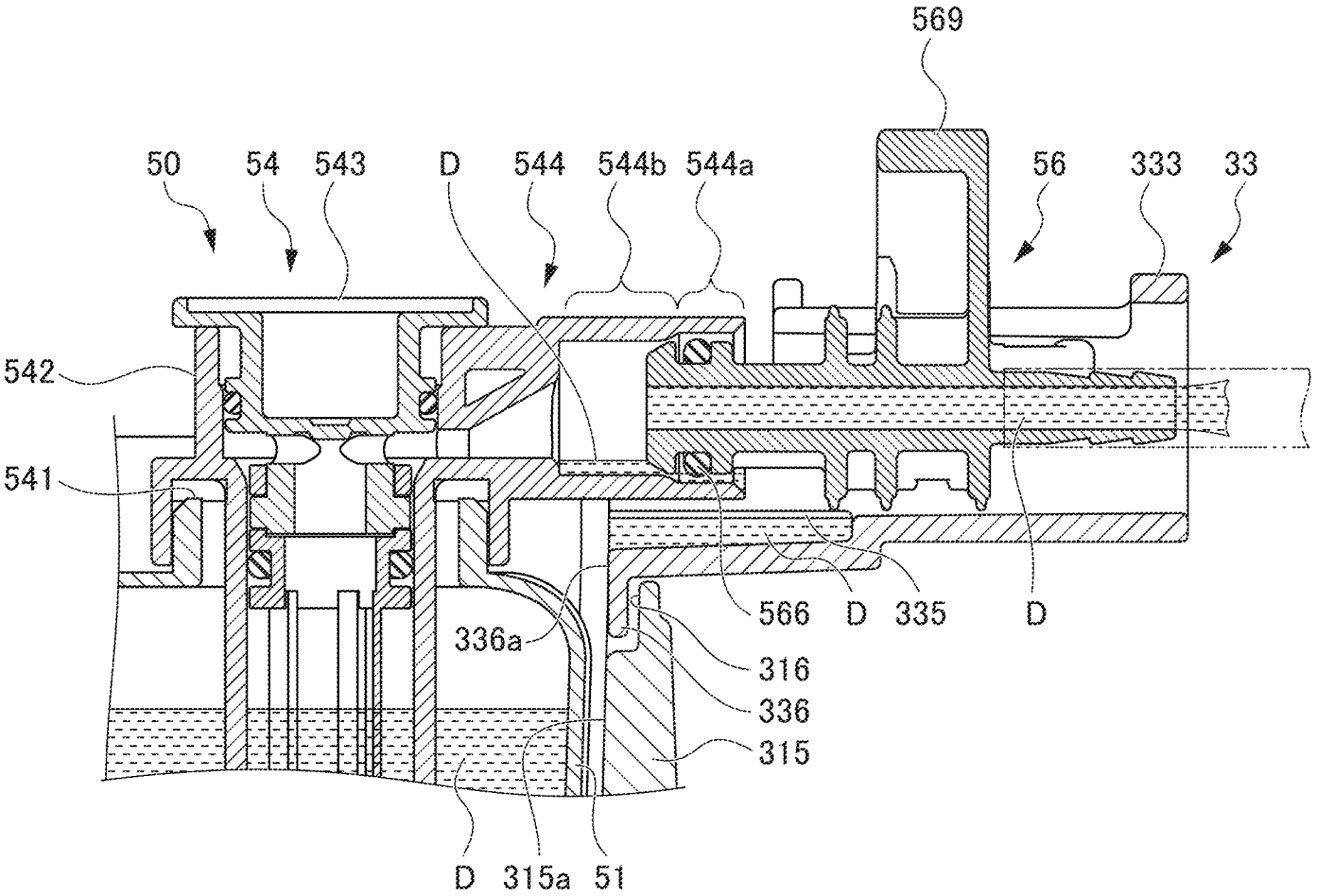
FIG. 14 is an enlarged sectional view illustrating a state where a detergent D is accumulated in the outflow detergent flow path 335 of the connection receiving portion 33 of the toilet device 100 according to the embodiment.

FIG. 11 is a perspective view illustrating a state where the functional unit 30 of the toilet device 100 according to the embodiment of the present invention is yet to be fixed with respect to the toilet portion 10. FIG. 12 is an enlarged sectional view illustrating a state where the pipe member connection part 56 is inserted into and connected to the detergent tank discharge opening 54 of the detergent tank 50 of the toilet device 100 according to the embodiment. FIG. 13 is an enlarged sectional view illustrating a state where the pipe member connection part 56 begins to be pulled out from the detergent tank discharge opening 54 of the detergent tank 50 of the toilet device 100 according to the embodiment. FIG. 14 is an enlarged sectional view illustrating a state where a detergent D is accumulated in the outflow detergent flow path 335 of the connection receiving portion 33 of the toilet device 100 according to the embodiment.

In the following description, the direction from the functional unit 30 toward the toilet cover 302 (lower left direction in FIG. 1) will be defined as a forward direction, the direction opposite to the forward direction will be defined as a backward direction, and the forward direction and the backward direction will be defined as a forward-backward direction. In addition, the direction from the toilet portion 10 toward the functional unit 30 (upward direction in FIG. 1) will be defined as an upward direction, the direction opposite to the upward direction will be defined as a downward direction, and the upward direction and the downward direction will be defined as an upward-downward direction. In addition, the direction from a side on which a cleaning switch 301 is disposed, which is a side surface of the functional unit 30, toward a side on which the cleaning switch 301 is not disposed (upper left direction in FIG. 1) will be defined as a leftward direction, the direction opposite to the leftward direction will be defined as a rightward direction, and the leftward direction and the rightward direction will be defined as a leftward-rightward direction.

A hose fixing portion 311 is fixed to the substantially middle portion of the base plate 31. The hose fixing portion 311 is fixed to the upper surface side of the fixing plate 111 and extends upward beyond the bottom surface of the base plate 31 through the base plate 31. A hose connection member 312 (described later) is inserted into and connected to the hose fixing portion 311.

In addition, the base plate 31 has the detergent tank holding portion 315. The detergent tank holding portion 315 has a bottom surface (not illustrated) and a side wall 317. The upper end portion of the side wall 317 constitutes an opening portion that opens upward. The detergent tank 50 is inserted from above into the detergent tank holding portion 315, and the detergent tank 50 can be stored in a held state. As illustrated in FIGS. 9, 12, and so on, a recessed portion 316 recessed to the outside of the space in which the detergent tank 50 is stored is formed in the upper portion of the side wall 317 and a notch portion 318 (refer to FIG. 9) that is cut downward is formed at a part of the upper end portion of the side wall 317 positioned in the upper end portion of the recessed portion 316. A lower flange portion 336 constituting one end portion of the connection receiving portion 33 is fitted into the notch portion 318 and the recessed portion 316, and the connection receiving portion 33 is connected and fixed with respect to the opening portion of the detergent tank holding portion 315. As illustrated in FIG. 12 and so on, an inner surface 336*a* of the lower flange portion 336 facing the detergent tank 50 and an inner surface 315*a* of the detergent tank holding portion 315 (inner surface 315*a* at a part other than the part where the recessed portion 316 is formed) have a flush relationship.

The connection receiving portion 33 supports the pipe member connection part 56 and constitutes a sliding structure guiding the pipe member connection part 56 such that the pipe member connection part 56 advances and retreats with respect to the detergent tank 50. Specifically, the connection receiving portion 33 has a tubular portion 331 that has a substantially tubular shape and a positional relationship in which the shaft center thereof is parallel to a substantially horizontal direction as illustrated in FIG. 6, and the pipe member connection part 56 is guided by the tubular portion 331 such that the pipe member connection part 56 advances and retreats with respect to the detergent tank 50 by the pipe member connection part 56 sliding with respect to the inner peripheral surface of the tubular portion 331. The part of the peripheral wall of the tubular portion 331 that is a peripheral surface part positioned on the upper side as illustrated in FIG. 9 is open upward. At the half part of one end side of the tubular portion 331 in the longitudinal direction of the tubular portion 331, the opening is wide open as illustrated in FIG. 6 such that more than half of the upper side of the peripheral surface of the tubular portion 331 is removed. In addition, the other end portion part with respect to one end portion of the tubular portion 331 has an annular portion 333 that is not open upward. The annular portion 333 constitutes a second engaged portion.

The outflow detergent flow path 335 is formed at the part of the inner peripheral surface of the tubular portion 331 that is positioned on the lower side. As illustrated in FIG. 6, a groove extending in parallel to the shaft center of the tubular portion 331 from one end portion of the tubular portion 331, which is one end portion of the connection receiving portion 33, toward the other end portion of the tubular portion 331 until reaching the substantially middle position of the tubular portion 331 in the longitudinal direction constitutes the outflow detergent flow path 335. The detergent flowing out from a detergent supply path of the hose 55 (described later) as the pipe member is capable of flowing into the outflow detergent flow path 335 when the detergent tank 50 is removed from the detergent tank holding portion 315. The outflow detergent flow path 335 is inclined downward toward the detergent tank holding portion 315 and is open toward the space of the detergent tank holding portion 315 storing the detergent tank 50 in one end portion of the tubular portion 331. In other words, the detergent tank holding portion 315 and the connection receiving portion 33 fixed with respect to the detergent tank holding portion 315 have a relationship supporting the detergent tank 50 and the pipe member connection part 56 connected to or separated from the detergent tank 50.

The connection receiving portion 33 has the lower flange portion 336 protruding in a flange shape only downward from one end portion of the tubular portion 331. In addition, the connection receiving portion 33 has a screw fixed portion 337 protruding on the peripheral surface in the direction away from the peripheral surface of the tubular portion 331. The connection receiving portion 33 is fixed to the base plate 31 by the screw fixed portion 337 being fixed to the base plate 31 by a screw 338 and the part of the tubular portion 331 connected to the lower flange portion 336 being fitted into the notch portion 318 in the upper end portion of the side wall 317 of the detergent tank holding portion 315 as described above by the lower flange portion 336 abutting against the inner surface of the wall portion of the part of the detergent tank holding portion 315 where the notch portion 318 is formed (inner surface of the side wall 317 that forms the space accommodating the detergent tank 50 in the detergent tank holding portion 315). As a result, the detergent flowing into the outflow detergent flow path 335 is capable of flowing into the space accommodating the detergent tank 50 in the detergent tank holding portion 315 from the opening in one end portion of the tubular portion 331 without leaking from the part where the connection receiving portion 33 and the detergent tank holding portion 315 are connected to each other.

The connection receiving portion 33 has a receiving portion notch 341 as a first engaged portion. The receiving portion notch 341 is formed in a surrounding wall portion 342 of the tubular portion 331 that surrounds a part of the pipe member connection part 56 (described later) as illustrated in FIG. 9 and so on and has a groove shape extending in a circumferential direction with respect to the axial direction of the pipe member connection part 56 corresponding to the direction in which the pipe member connection part 56 advances and retreats.

As illustrated in FIG. 8, the detergent tank 50 has a tank main body 51 that has a substantially rectangular parallelepiped-shaped outer appearance. A knob portion 52 is disposed at the middle position of the upper surface of the tank main body 51. The knob portion 52 is connected by integral molding to the tank main body 51. A base portion 521 of the knob portion 52 is constricted and thinly formed, and an end portion 522 is expanded in diameter. As a result of this configuration, the knob portion 52 can be pinched with ease and has a shape that does not occupy a wide space in the upper surface of the tank main body 51.

A detergent injection port 531 is formed in one end portion on the diagonal line of the upper surface of the tank main body 51. A male screw is formed at the detergent injection port 531, the female screw of a cap 532 meshes with the male screw, and the detergent injection port 531 is blocked by the circular cap 532. The cap 532 can be removed from the detergent injection port 531 or the detergent injection port 531 can be blocked with the cap 532 by the cap 532 being rotated with respect to the tank main body 51. In addition, the cap 532 has a protruding portion 533 (protruding portion 533 protruding to the outside in the radial direction of the circular cap 532) protruding to the outside of the cap 532 at a part of the peripheral surface thereof. When the tank main body 51 is accommodated and held in the detergent tank holding portion 315, the protruding portion 533 is capable of abutting against the side wall 317 constituting the detergent tank holding portion 315 when the cap 532 rotates.

When the tank main body 51 is accommodated and held in the detergent tank holding portion 315 in this configuration, rotation of the cap 532 with respect to the tank main body 51 results in no extra rotation, as the protruding portion 533 abuts against the side wall 317 constituting the detergent tank holding portion 315 as a result of the rotation, and the cap 532 cannot be removed from the tank main body 51. Accordingly, the detergent cannot be injected into the detergent tank 50 when the tank main body 51 is held in the detergent tank holding portion 315. Therefore, overflowing of the detergent around the detergent tank 50 that is attributable to the cap 532 of the detergent tank 50 being opened and the detergent being injected when the tank main body 51 is held in the detergent tank holding portion 315 can be prevented.

The other end portion on the diagonal line of the upper surface of the tank main body 51 has the detergent tank discharge opening 54. Accordingly, the cap 532, the knob portion 52, and the detergent tank discharge opening 54 are arranged in a straight line on the upper surface of the tank main body 51. The detergent tank discharge opening 54 has a discharge opening portion 541 that an opening portion formed in the tank main body 51 constitutes, an L-shaped discharge pipe member 542 inserted and fitted into the discharge opening portion 541, and an upper lid portion 543. The L-shaped discharge pipe member 542 has a tank insertion portion (not illustrated) inserted into the detergent tank 50, positioned in the tank main body 51, and suctioning the detergent and the discharge tube portion 544 discharging the detergent suctioned into the tank insertion portion (not illustrated). The upper lid portion 543 is fixed to the L-shaped discharge pipe member 542 to cover the L-shaped discharge pipe member 542 from above at the part of the L-shaped discharge pipe member 542 where the tank insertion portion and the discharge tube portion 544 are connected to each other and the L-shaped discharge pipe member 542 is bent at a right angle. The discharge tube portion 544 has an open large diameter portion **544*a* with a large inner diameter and a small diameter portion 544*b* smaller in inner diameter than the open large diameter portion 544*a*. The pipe member connection part 56 for connecting the hose 55 as the pipe member to the detergent tank discharge opening 54 can be inserted into the discharge tube portion 544, and thus the discharge tube portion 544 of the detergent tank discharge opening 54 constitutes an inserted portion into which the pipe member connection part 56 can be inserted. The detergent in the detergent tank 50 is discharged from the inside of the tank main body 51 to the outside of the tank main body 51 through the L-shaped discharge pipe member 542 and the discharge tube portion 544**.

In this configuration, the detergent discharged from the detergent tank discharge opening 54 is supplied to the ejector (not illustrated) through the pipe member that has the detergent supply path. Specifically, the hose 55 constitutes the pipe member. The space in the hose 55 that is formed by the inner peripheral surface of the hose 55 constitutes the detergent supply path through which the detergent circulates. The pipe member connection part 56 is fixed to one end portion of the hose 55. In other words, the pipe member connection part 56 connects the detergent tank 50 and the hose 55 that has the detergent supply path through which the detergent is supplied to the toilet (toilet portion 10) after the detergent is supplied from the detergent tank 50 to each other by being connected to the detergent tank discharge opening 54. In addition, the hose connection member 312 is connected to the other end portion of the hose 55. The hose 55 can be held by the pipe member holding portion 61 disposed in the functional unit 30.

An annular member bent in an L-shape constitutes the hose connection member 312. One end portion of the hose connection member 312 is inserted into the other end portion of the hose 55. The other end portion of the hose connection member 312 is inserted into a cylindrical portion 313 (refer to FIG. 11) formed in the hose fixing portion 311 and connected to the cylindrical portion 313. The pipe member connection part 56 has a shaft portion 561, a projection portion 562 as a first engaging portion, and a protruding portion 563 as a second engaging portion as illustrated in FIG. 7, is supported by the connection receiving portion 33, and constitutes a sliding structure guided by the connection receiving portion 33 to advance and retreat with respect to the detergent tank 50. An end portion flange portion 565 that has a flange shape is disposed in one end portion of the shaft portion 561 by being integrally molded with one end portion of the shaft portion 561. A groove going around in the circumferential direction of the end portion flange portion 565 is formed in the peripheral surface of the end portion flange portion 565, and an O ring 566 is fitted into and disposed in the groove. The O ring 566 provides sealing between the end portion flange portion 565 and the small diameter portion **544*b* of the discharge tube portion 544 (refer to FIG. 8) and prevents the detergent from leaking from the space between the end portion flange portion 565 and the small diameter portion 544***b* of the discharge tube portion 544.

Three middle flange portions 567 are disposed at the substantially middle parts in the longitudinal direction of the shaft portion 561. A rib 564 is disposed at the part between the end portion flange portion 565 and the middle flange portion 567 and the part between the first one to the third one of the three middle flange portions 567 in the direction from one end portion toward the other end portion of the shaft portion 561. A plurality of the ribs 564 is disposed at regular intervals in the circumferential direction of the shaft portion 561.

The projection portion 562 is disposed to straddle the second one and the third one of the three middle flange portions 567 in the direction from one end portion toward the other end portion of the shaft portion 561 by being integrally molded with each of the middle flange portions 567. The projection portion 562 protrudes from the middle flange portion 567 to the outside in the radial direction of the shaft portion 561, which is a direction away from the shaft portion 561. The section of the projection portion 562 that is cut in the direction orthogonal to the protruding direction of the projection portion 562 has an L-shape. A first side wall 568, which constitutes the L-shape with a second side wall 569, has a positional relationship orthogonal to the longitudinal direction of the shaft portion 561, and the second side wall 569 has a positional relationship parallel to the longitudinal direction of the shaft portion 561.

The first side wall 568 can be engaged with each receiving portion notch 341 of the connection receiving portion 33 by the pipe member connection part 56 being guided by the connection receiving portion 33 and moved in the longitudinal direction of the shaft portion 561. When the first side wall 568 is engaged with the receiving portion notch 341 of the connection receiving portion 33, the pipe member connection part 56 is at a tank connection position inserted into and connected to the discharge tube portion 544 of the detergent tank discharge opening 54. In other words, the pipe member connection part 56 has the projection portion 562 as the first engaging portion that can be engaged with the receiving portion notch 341 as the first engaged portion when the pipe member connection part 56 is connected to the discharge tube portion 544 of the detergent tank discharge opening 54.

The pipe member connection part 56 has a pair of axial-direction extending portions 571. Each of the axial-direction extending portions 571 extends in the direction from one end portion toward the other end portion of the shaft portion 561 in parallel to the axial direction of the shaft portion 561 from the third middle flange portion 567 in the direction from one end portion toward the other end portion of the shaft portion 561 and extends until reaching a position close to one end slightly ahead of the other end portion of the shaft portion 561. The protruding portion 563 is disposed by being integrally molded with the extending end portion of each axial-direction extending portion 571, and each protruding portion 563 extends and protrudes in the direction away from the shaft center of the pipe member connection part 56 in the extending end portion of the axial-direction extending portion 571 that is the rear end portion part in the direction in which the pipe member connection part 56 advances and retreats. A step portion 573 for fixing the hose 55 to the other end portion of the shaft portion 561 is disposed on the peripheral surface of the other end portion of the shaft portion 561.

When the detergent tank 50 is removed from the detergent tank holding portion 315, the protruding portion 563 jumps to the outside from the tubular portion 331 of the pipe member connection part 56 beyond the annular portion 333 as the second engaged portion of the connection receiving portion 33, opens to the outside in the radial direction of the tubular portion 331, and is engaged with the annular portion 333 by the pipe member connection part 56 being guided by the connection receiving portion 33 and moved in the longitudinal direction of the shaft portion 561, which is the direction in which the pipe member connection part 56 retreats from the detergent tank 50. The annular portion 333 constitutes the rear end portion of the connection receiving portion 33 in the direction in which the pipe member connection part 56 advances and retreats, and this engagement allows the protruding portion 563 protruding from the tubular portion 331 to be fixed with respect to the tubular portion 331 such that the protruding portion 563 does not move into the tubular portion 331 (such that the protruding portion 563 does not move into the tubular portion 331 by the pipe member connection part 56 moving in the shaft center direction of the shaft portion 561) and a state where the pipe member connection part 56 is removed from the discharge tube portion 544 of the detergent tank discharge opening 54 of the detergent tank 50 is maintained. In other words, the pipe member connection part 56 has the protruding portion 563 as the second engaging portion that can be engaged with the annular portion 333 as the second engaged portion when the pipe member connection part 56 is removed from the detergent tank 50.

As illustrated in FIG. 10, the pipe member holding portion 61 has a hose support plate portion 62 that has a plate-shaped part, a first wall portion 63, a second wall portion 64, and a temporary placement portion 65. The hose support plate portion 62 is fixed with respect to the base plate 31 and supports the hose 55 from below. The first wall portion 63 protrudes upward from the upper surface of the hose support plate portion 62 and extends along the upper surface of the hose support plate portion 62 in a substantially oval shape in the plan view that is illustrated in FIG. 10. The second wall portion 64 protrudes upward from the upper surface of the hose support plate portion 62, extends from a position facing the entire surface of the rear side of the first wall portion 63 through a position facing the left side of the first wall portion 63 until reaching a position facing the substantially middle position of the front side of the first wall portion 63 in the leftward-rightward direction, and extends forward from that position.

A groove 67 for holding the hose 55 is formed by the first wall portion 63, the second wall portion 64, and the hose support plate portion 62, and the hose 55 is bent and deflected in a substantially S-shape by the hose 55 being fitted into the groove 67. As a result of the state where the hose 55 is deflected by the pipe member holding portion 61 as described above, a deflected state can be achieved also at the part near one end portion of the hose 55 not held in the pipe member holding portion 61. In a case where one end portion of the hose 55 has a straight line shape without being deflected, the distance from the detergent tank discharge opening 54 to the hose connection member 312 of the hose fixing portion 311 is short, and thus the pipe member connection part 56 is hardly capable of advancing and retreating with respect to the detergent tank 50 in a stable manner due to the repulsion that is attributable to the elasticity of the hose 55. By the deflected state where the part near one end portion of the hose 55 can be deformed such that a substantially S-shape is stably maintained being achieved as in the present embodiment, however, one end portion of the hose 55 is held in the pipe member holding portion 61 to be capable of advancing and retreating with respect to the detergent tank 50 along with the pipe member connection part 56. Specifically, when the pipe member connection part 56 advances and retreats with respect to the detergent tank 50 by the pipe member connection part 56 moving between the tank connection position that is illustrated in FIG. 4 and the tank removal position that is illustrated in FIG. 5, the hose 55 can be stably deformed from the state of the hose 55 illustrated in FIG. 4 to the state of the hose 55 illustrated in FIG. 5 and from the state of the hose 55 illustrated in FIG. 5 to the state of the hose 55 illustrated in FIG. 4 and advancing and retreating with respect to the detergent tank 50 by the pipe member connection part 56 are facilitated.

The temporary placement portion 65 temporarily fixes the part near the other end portion of the hose 55 to the base plate 31. Specifically, the temporary placement portion 65 has the pair of hook portions 651 protruding upward from the upper surface of the hose support plate portion 62. As illustrated in FIG. 10, the part near one end portion of the hose 55 is temporarily sandwiched and fixed by the pair of hook portions 651. More specifically, the state where the part near one end portion of the hose 55 is sandwiched and fixed by the pair of hook portions 651 is achieved during shipment from an assembly plant in a case where the toilet portion 10 and the functional unit 30 are manufactured as separate bodies in the assembly plant and then are transported to the site of a house where the toilet device 100 is installed and assembled at the site. Then, the toilet portion 10 and the functional unit 30 are transported to the site of the house where the toilet device 100 is installed and the functional unit 30 is fixed with respect to the toilet portion 10 as illustrated in FIG. 3. Subsequently, a worker at the site easily finds out the part near the other end portion of the hose 55 fixed to the hook portion 651 from the base plate 31 of the functional unit 30 in which multiple components are accommodated, removes the part from the hook portion 651, inserts the hose connection member 312 into the hose fixing portion 311, and connects the hose connection member 312 to the hose fixing portion 311.

Attachment and detachment of the detergent tank 50 to and from the toilet device 100 according to the present embodiment provided with the above-described configuration will be described. Firstly, the rear upper surface cover 303 is opened for the detergent tank 50 held in the detergent tank holding portion 315 to be removed, and then a state occurs where the detergent tank 50 and the pipe member connection part 56 are exposed as illustrated in FIG. 2. The pipe member connection part 56 is rotated about the shaft center of the shaft portion 561 of the pipe member connection part 56. As a result, the engagement of the first side wall 568 of the projection portion 562 with the receiving portion notch 341 is released. Then, the pipe member connection part 56 is guided by the connection receiving portion 33 by sliding with respect to the tubular portion 331 and is retreated with respect to the detergent tank 50.

At this time, a negative pressure is generated in the hose 55 by the pipe member connection part 56 being pulled out from the discharge tube portion 544 of the detergent tank discharge opening 54, and the detergent D in the detergent tank 50 is suctioned upward by the negative pressure and accumulated in the space surrounded by the O ring 566 and the inner surface of the small diameter portion 544*b* of the discharge tube portion 544 as illustrated in FIG. 13. Furthermore, by the pipe member connection part 56 being pulled out from the discharge tube portion 544 of the detergent tank discharge opening 54, the O ring 566 is positioned in the open large diameter portion 544*a* of the discharge tube portion 544, the sealing by the O ring 566 is released, and air flows into the discharge tube portion 544 as illustrated in FIG. 14. As a result, the detergent D flows out from the inside of the discharge tube portion 544. The detergent D that flows out flows into the outflow detergent flow path 335 positioned vertically below the pipe member connection part 56 and flows down to the space surrounded by the detergent tank holding portion 315 and accommodating the tank main body 51 of the detergent tank 50 due to the inclination of the outflow detergent flow path 335.

Then, the protruding portion 563 (refer to FIG. 7) of the pipe member connection part 56 is retreated with respect to the detergent tank 50 beyond the annular portion 333 of the connection receiving portion 33. As a result, the protruding portion 563 jumps to the outside beyond the annular portion 333 and is engaged with the annular portion 333, and the pipe member connection part 56 is fixed to the connection receiving portion 33 in a state of being removed from the discharge tube portion 544 of the detergent tank discharge opening 54 of the detergent tank 50. As a result, a state occurs where the detergent tank 50 can be pulled out and removed from the detergent tank holding portion 315.

Then, the detergent tank 50 is removed from the detergent tank holding portion 315. The cap 532 of the detergent tank 50 is removed from the tank main body 51 by the cap 532 being rotated after the removal of the detergent tank 50. Then, the detergent is injected into the tank main body 51 from the detergent injection port 531 and the tank main body 51 is filled with the detergent. Then, the cap 532 is rotated in the direction that is opposite to the direction of the previous rotation. As a result, the cap 532 is attached to the tank main body 51 in a state where the detergent injection port 531 is blocked.

Next, the tank main body 51 of the detergent tank 50 is inserted into the detergent tank holding portion 315, and a state is achieved where the tank main body 51 is accommodated in the detergent tank holding portion 315. Next, a pair of the protruding portions 563 of the pipe member connection part 56 is pushed in to the inner peripheral surface side of the annular portion 333 such that the protruding portions 563 approach each other inward in the radial direction of the shaft portion 561. As a result, the engagement of the protruding portion 563 of the pipe member connection part 56 with the annular portion 333 of the connection receiving portion 33 is released.

Next, the pipe member connection part 56 is advanced toward the discharge tube portion 544 of the detergent tank discharge opening 54 of the detergent tank 50 by being slid with respect to the tubular portion 331 and guided by the connection receiving portion 33. Then, the pipe member connection part 56 is inserted into the discharge tube portion 544 of the detergent tank discharge opening 54. Next, the first side wall 568 of the projection portion 562 is engaged with the receiving portion notch 341 by the pipe member connection part 56 being rotated about the shaft center of the shaft portion 561 of the pipe member connection part 56. As a result, a state where the pipe member connection part 56 is connected to the discharge tube portion 544 of the detergent tank discharge opening 54 is achieved, the pipe member connection part 56 is fixed to the connection receiving portion 33, and attachment (connection) of the tank main body 51 of the detergent tank 50 to the detergent tank holding portion 315 is completed.

The following effects can be achieved with the toilet device 100 according to the embodiment configured as described above. As described above, the toilet device 100 has the detergent tank 50 that has the detergent tank discharge opening 54 and the pipe member connection part 56 that connects the detergent tank 50 and the hose 55 as the pipe member which has the detergent supply path through which the detergent is supplied to the toilet portion 10 after the detergent is supplied from the detergent tank 50 to each other by being connected to the detergent tank discharge opening 54. The pipe member connection part 56 constitutes a sliding structure advancing and retreating with respect to the detergent tank 50.

With this configuration, the hose 55 supplying the detergent to the toilet portion 10 can be connected with respect to the detergent tank 50 or the pipe member connection part 56 can be removed from the detergent tank 50 without a movement of the detergent tank 50 by the pipe member connection part 56 being advanced and retreated with respect to the detergent tank 50. Accordingly, connection of the pipe member connection part 56 to the detergent tank discharge opening 54 can be facilitated. Therefore, the toilet device 100 is installed with ease.

In addition, the sliding structure has the connection receiving portion 33 disposed in the base plate 31 as the support member supporting the detergent tank 50, supporting the pipe member connection part 56, and guiding the pipe member connection part 56 such that the pipe member connection part 56 advances and retreats with respect to the detergent tank 50. With this configuration, positioning of the pipe member connection part 56 with respect to the discharge tube portion 544 of the detergent tank discharge opening 54 at a time when the pipe member connection part 56 is inserted into the discharge tube portion 544 of the detergent tank discharge opening 54 can be performed with ease, and the pipe member connection part 56 can be easily connected to the discharge tube portion 544 of the detergent tank discharge opening 54.

In addition, the connection receiving portion 33 has the outflow detergent flow path 335 allowing inflow of the detergent flowing out from the detergent supply path in the hose 55. Although the detergent supply path in the hose 55 has a negative pressure when the pipe member connection part 56 is pulled out from the detergent tank discharge opening 54, this configuration is capable of preventing the detergent flowing out from the detergent supply path due to the negative pressure from spreading into the functional unit 30.

In addition, the outflow detergent flow path 335 is inclined toward the detergent tank holding portion 315 of the base plate 31 as the support member holding the detergent tank 50. With this configuration, the detergent flowing out from the detergent supply path to the outflow detergent flow path 335 can be collected in the space of the detergent tank holding portion 315 accommodating the tank main body 51.

In addition, the detergent tank discharge opening 54 has the discharge tube portion 544 as the inserted portion into which the pipe member connection part 56 can be inserted. With this configuration, the pipe member connection part 56 can be connected to the detergent tank discharge opening 54 by the pipe member connection part 56 being inserted into the discharge tube portion 544 of the detergent tank discharge opening 54. Accordingly, an O ring or the like does not have to be disposed in the discharge opening on the detergent tank 50 side and a configuration is possible in which the O ring 566 is disposed at the pipe member connection part 56. As a result, adhesion of dirt and the like to a seal member that the O ring constitutes or damage to the seal member can be prevented on the detergent tank 50 side, which is likely to undergo adhesion of dirt and the like by being removed from the functional unit 30, when the detergent tank 50 is filled with the detergent.

In addition, in a case where the detergent tank discharge opening 54 is configured to be inserted into the pipe member connection part 56, a large amount of the detergent with which the detergent supply path in the hose 55 connected to the pipe member connection part 56 is filled flows out from the pipe member connection part 56 when the detergent tank discharge opening 54 is pulled out from the pipe member connection part 56. However, in the case of the present embodiment, in contrast, the pipe member connection part 56 is configured to be inserted into the detergent tank discharge opening 54, and thus the amount of the outflow portion of the detergent with which the detergent supply path in the hose 55 is filled can be small.

In addition, the connection receiving portion 33 has the first engaged portion. The pipe member connection part 56 has the first engaging portion that can be engaged with the first engaged portion when the pipe member connection part 56 is connected to the detergent tank discharge opening 54. The connection receiving portion 33 has the surrounding wall portion 342 that surrounds a part of the pipe member connection part 56 and the receiving portion notch 341 that constitutes the first engaged portion and extends in the circumferential direction with respect to the axial direction of the pipe member connection part 56 corresponding to the direction in which the pipe member connection part 56 advances and retreats. In addition, the pipe member connection part 56 has the shaft portion 561 and the projection portion 562 constituting the first engaging portion and protruding in the direction away from the shaft portion 561. With this configuration, a state where the pipe member connection part 56 and the hose 55 are connected to the detergent tank discharge opening 54 can be reliably maintained by the projection portion 562 as the first engaging portion being engaged with the receiving portion notch 341 as the first engaged portion.

In addition, the connection receiving portion 33 has the second engaged portion. The pipe member connection part 56 has the second engaging portion that can be engaged with the second engaged portion when the pipe member connection part 56 is removed from the detergent tank 50. The annular portion 333 as the rear end portion of the connection receiving portion 33 in the direction in which the pipe member connection part 56 advances and retreats constitutes the second engaged portion. The pair of protruding portions 563 extending and protruding in the direction away from the shaft center of the pipe member connection part 56 in the rear end portion in the direction in which the pipe member connection part 56 advances and retreats constitutes the second engaging portion. With this configuration, the pipe member connection part 56 and the hose 55 can be reliably maintained at the position of the pipe member connection part 56 at which the pipe member connection part 56 is removed from the detergent tank discharge opening 54, which is a position at which the detergent tank 50 can be attached and detached with respect to the base plate 31 as the support member, by the pair of protruding portions 563 as the second engaging portion being engaged with the annular portion 333 of the connection receiving portion 33 as the second engaged portion.

The present invention is not limited to the embodiment described above, and modifications, improvements, and the like within a scope allowing the object of the present invention to be achieved are included in the present invention.

For example, the configuration of each portion of the toilet device is not limited to the configuration of each portion of the present embodiment. For example, although the hose 55 for supplying the detergent stored in the detergent tank 50 to the toilet portion 10 constitutes the pipe member in the present embodiment, the present invention is not limited thereto. The pipe member may have a fluid supply path through which a fluid is supplied to the toilet portion. Accordingly, for example, a hose for supplying water from the functional unit side to a local cleaning mechanism disposed in the toilet portion may also constitute the pipe member.

In addition, for example, although the cap 532 attached to the detergent injection port 531 of the tank main body 51 has a circular shape in the present embodiment, the present invention is not limited thereto. Accordingly, the protruding portion may protrude to the outside of the cap at a part of the peripheral surface of the cap. Likewise, the configurations of the first engaging portion, the first engaged portion, the second engaging portion, and the second engaged portion are not limited to the configuration of the present embodiment.

EXPLANATION OF REFERENCE NUMERALS

10 Toilet portion
30 Functional unit
31 Base plate (support member)
33 Connection receiving portion
50 Detergent tank
54 Detergent tank discharge opening
55 Hose (pipe member)
56 Pipe member connection part (sliding structure)
61 Pipe member holding portion
63 First wall portion (wall portion)
64 Second wall portion (wall portion)
65 Temporary placement portion
100 Toilet device
315 Detergent tank holding portion
333 Annular portion (second engaged portion)
335 Outflow detergent flow path
341 Receiving portion notch (first engaged portion)
342 Surrounding wall portion
544 Discharge tube portion (inserted portion)
561 Shaft portion
562 Projection portion (first engaging portion)
563 Protruding portion (second engaging portion)
651 Hook portion

The invention claimed is:

1. A toilet device comprising:

a detergent tank including a detergent tank discharge opening; and a pipe member connection part connecting the detergent tank and a pipe member having a detergent supply path through which a detergent is supplied to a toilet portion after the detergent is supplied from the detergent tank by being connected to the detergent tank discharge opening, wherein the pipe member connection part constitutes a sliding structure advancing and retreating with respect to the detergent tank, and wherein the detergent tank, the pipe member, and the pipe member connection part are provided in a functional unit at a rear of a toilet main body of a toilet portion.

2. The toilet device of claim 1, wherein the sliding structure has a connection receiving portion disposed in a support member supporting the detergent tank, supporting the pipe member connection part, and guiding the pipe member connection part such that the pipe member connection part advances and retreats with respect to the detergent tank.

3. The toilet device of claim 2, wherein the connection receiving portion has an outflow detergent flow path allowing inflow of the detergent flowing out from the detergent supply path.

4. A toilet device comprising:

a detergent tank including a detergent tank discharge opening; and a pipe member connection part connecting the detergent tank and a pipe member having a detergent supply path through which a detergent is supplied to a toilet portion after the detergent is supplied from the detergent tank by being connected to the detergent tank discharge opening, wherein the pipe member connection part constitutes a sliding structure advancing and retreating with respect to the detergent tank, wherein the detergent tank, the pipe member, and the pipe member connection part are provided in a functional unit at a rear of a toilet main body of a toilet portion, wherein the sliding structure has a connection receiving portion disposed in a support member supporting the detergent tank, supporting the pipe member connection part, and guiding the pipe member connection part such that the pipe member connection part advances and retreats with respect to the detergent tank, wherein the connection receiving portion has an outflow detergent flow path allowing inflow of the detergent flowing out from the detergent supply path, wherein the outflow detergent flow path is inclined toward a detergent tank holding portion of the support member holding the detergent tank, and wherein an outflow detergent path that is inclined up to an end portion of the connection receiving portion guides a detergent into a detergent tank holding portion.

5. The toilet device of claim 2, wherein the detergent tank discharge opening has an inserted portion into which the pipe member connection part can be inserted.

6. A toilet device comprising:

a detergent tank including a detergent tank discharge opening; and a pipe member connection part connecting the detergent tank and a pipe member having a detergent supply path through which a detergent is supplied to a toilet portion after the detergent is supplied from the detergent tank by being connected to the detergent tank discharge opening, wherein the pipe member connection part constitutes a sliding structure advancing and retreating with respect to the detergent tank, wherein the detergent tank, the pipe member, and the pipe member connection part are provided in a functional unit at a rear of a toilet main body of a toilet portion, wherein the sliding structure has a connection receiving portion disposed in a support member supporting the detergent tank, supporting the pipe member connection part, and guiding the pipe member connection part such that the pipe member connection part advances and retreats with respect to the detergent tank, wherein the connection receiving portion has a first engaged portion, wherein the pipe member connection part includes a first engaging portion that can be engaged with the first engaged portion when the pipe member connection part is connected to the detergent tank discharge opening, and wherein when a pipe member connection part is removed, holding the pipe member connection part by rotating the pipe member connection part with respect to a notch of a connection receiving portion for engagement.

7. The toilet device of claim 6, wherein the connection receiving portion has a surrounding wall portion surrounding a part of the pipe member connection part and a receiving portion notch constituting the first engaged portion and extending in a circumferential direction with respect to an axial direction of the pipe member connection part corresponding to a direction in which the pipe member connection part advances and retreats, and wherein the pipe member connection part includes a shaft portion and a projection portion constituting the first engaging portion and protruding in a direction away from the shaft portion.

8. The toilet device of claim 2, wherein the connection receiving portion has a second engaged portion, and wherein the pipe member connection part includes a second engaging portion that can be engaged with the second engaged portion when the pipe member connection part is removed from the detergent tank.

9. The toilet device of claim 8, wherein a rear end portion of the connection receiving portion in the direction in which the pipe member connection part advances and retreats constitutes the second engaged portion, and wherein a pair of protruding portions extending in a direction away from a shaft center of the pipe member connection part in a rear end portion of the pipe member connection part in the direction in which the pipe member connection part advances and retreats constitutes the second engaging portion.

10. A toilet device comprising:

a detergent tank including a detergent tank discharge opening; and a pipe member connection part connecting the detergent tank and a pipe member having a detergent supply path through which a detergent is supplied to a toilet portion after the detergent is supplied from the detergent tank by being connected to the detergent tank discharge opening, wherein the pipe member connection part constitutes a sliding structure advancing and retreating with respect to the detergent tank, wherein the detergent tank, the pipe member, and the pipe member connection part are provided in a functional unit at a rear of a toilet main body of a toilet portion, wherein the sliding structure has a connection receiving portion disposed in a support member supporting the detergent tank, supporting the pipe member connection part, and guiding the pipe member connection part such that the pipe member connection part advances and retreats with respect to the detergent tank, wherein the connection receiving portion has a first engaged portion, wherein the pipe member connection part includes a first engaging portion that can be engaged with the first engaged portion when the pipe member connection part is connected to the detergent tank discharge opening, wherein when a pipe member connection part is removed, holding the pipe member connection part by rotating the pipe member connection part with respect to a notch of a connection receiving portion for engagement, and wherein an engaging portion of the pipe member connection part is integrally configured with an operating portion.

* * * * *